US005818167A

United States Patent [19]

Lapatovich et al.

[11] Patent Number: 5,818,167

[45] Date of Patent: Oct. 6, 1998

[54] ELECTRODELESS HIGH INTENSITY DISCHARGE LAMP HAVING A PHOSPHORUS FILL

[75] Inventors: Walter P. Lapatovich, Marlborough; Scott J. Butler, North Oxford, both of Mass.; Jason R. Bochinski, Springfield, Oreg.

[73] Assignee: Osram Sylvania Inc., Danvers, Mass.

[21] Appl. No.: 595,476

[22] Filed: Feb. 1, 1996

[51] Int. Cl.[6] ..... H01J 17/20; H01J 61/12; H01J 1/62; H01J 63/04

[52] U.S. Cl. ..... 313/572; 313/568; 313/484; 313/637

[58] Field of Search ..... 313/483–87, 493, 313/567–68, 572–73, 634–37; 315/111.01, 248, 267, 344, 268

[56] References Cited

U.S. PATENT DOCUMENTS

| | | | |
|---|---|---|---|
| 3,725,716 | 4/1973 | Yamasaki | 313/185 |
| 3,748,520 | 7/1973 | Silver | 313/184 |
| 3,911,318 | 10/1975 | Spero et al. | 315/111 X |
| 4,252,890 | 2/1981 | Haas | 430/292 |
| 4,476,413 | 10/1984 | Gough | 313/550 |
| 4,480,213 | 10/1984 | Lapatovich . | |
| 4,647,821 | 3/1987 | Lapatovich . | |
| 4,672,267 | 6/1987 | Lapatovich . | |
| 4,945,290 | 7/1990 | Gliasson | 315/246 |
| 5,151,633 | 9/1992 | Farrall | 315/248 |
| 5,207,505 | 5/1993 | Naraki | 362/373 |
| 5,404,076 | 4/1995 | Dolan | 313/572 |

FOREIGN PATENT DOCUMENTS

| | | | |
|---|---|---|---|
| 0 271 911 | 6/1988 | European Pat. Off. . | |
| 0420335 | 4/1991 | European Pat. Off. . | |
| WO92/08246 | 5/1992 | WIPO | H01J 61/18 |
| WO93/21655 | 10/1993 | WIPO | H01J 61/38 |
| WO94/08439 | 4/1994 | WIPO | H05B 41/16 |

OTHER PUBLICATIONS

D.A. MacLennan et al "SmalLong–Linved Stable Light Source for Projection Display Applications" SID 93 Digest pp. 716–719 (1993).

D.A. MacLennan et al. "Small Long–Lived Light Source for Projection Display Applications" (Reprint).

J.T. Dolan et al "A Novel High Efficacy Microwave Powered Light Source" 02 Sep. 1992 6$^{th}$ Inter. Symp. Science & Tech of Light Sources.

*Primary Examiner*—Sandra L. O'Shea
*Assistant Examiner*—Mack Haynes
*Attorney, Agent, or Firm*—William E. Meyer

[57] ABSTRACT

An electrodeless high intensity discharge lamp including a sealed light-transmissive envelope, a volatilizable chemical fill and an inert gas or nitrogen within the envelope. The chemical fill includes as a primary active component phosphorus or a volatilizable compound of phosphorus. The inert gas or nitrogen is at a pressure of less than 760 torr at ambient temperature, and assists in starting the lamp. Sufficient mercury may be added to the lamp fill to improve resistive heating, but addition of mercury is not required for emission. Sulfur, a sulfur compound, or a metal halide may be added to the fill as a secondary active component. The lamp envelope is coupled to a high frequency power source to produce a light emitting plasma discharge within the envelope.

16 Claims, 2 Drawing Sheets

ELECTRODELESS HIGH INTENSITY DISCHARGE LAMP HAVING A PHOSPHORUS FILL

CROSS-REFERENCE TO RELATED APPLICATIONS

The present application contains subject matter related to U.S. application Ser. No. 08/595,475, commonly assigned and filed concurrently herewith. Application Ser. No. 08/595,475 is incorporated herein by reference.

BACKGROUND OF THE INVENTION

The present invention relates to electrodeless discharge light sources, and particularly to electrodeless lamps having a fill energized by high frequency, e.g., microwave power.

Until recently, all commercially available high intensity discharge (HID) lamps contained mercury or mercury salts, with other metal salts added to enhance or tailor the spectral output. Over the past several years, environmental concerns have led to attempts to produce mercury-free HID lamps. Of particular concern has been the discarding of spent lamps, releasing mercury into the environment.

One example of a mercury-free lamp which has been developed is a mercury-free high pressure sodium lamp having a fill of sodium and a high pressure (above atmospheric) of an inert gas. Some examples of sodium halide and oxyhalide lamps are described in U.S. Pat. Nos. 4,672,267, 4,801,846, and 5,070,277. Like all lamps containing reactive chemical fills, these lamps are subject to wall reactions which can affect the optical properties of the arc lamp and alter the chemistry from that initial to the lamp.

In another type of mercury-free lamp sulfur, selenium, or compounds thereof are included in the lamp fill, and are excited by electromagnetic power in excess of about 50 watts/cc, preferably in excess of 100 watts/cc. Other known electrodeless lamps contain metal halides or oxyhalides. Although these have good color rendering properties and high lumen output, most of these also include mercury.

Accordingly, it is an object of the present invention to provide an electrodeless high intensity discharge lamp that overcomes the disadvantages of prior art lamps.

It is another object of the invention to provide an electrodeless high intensity discharge lamp having a phosphorus-based fill.

It is yet another object of the present invention to provide a mercury-free electrodeless high intensity discharge lamp having a phosphorus-based fill.

It is still another object of the invention to provide an electrodeless high intensity discharge lamp having a phosphorus-based fill which is free of both mercury and metal halides.

It is a further object of the invention to provide a mercury-free electrodeless high intensity discharge lamp having a phosphorus-based fill including a small amount of a metal halide and emitting light over a broad spectral range.

These and still further objects, features, and advantages of the present invention will become apparent upon consideration of the following description.

SUMMARY OF THE INVENTION

The invention is an electrodeless high intensity discharge (HID) lamp in which the primary active component is phosphorus or a volatilizable compound of phosphorus, emitting light in the blue to ultraviolet range of the spectrum.

In one embodiment, the invention is an electrodeless HID lamp including a sealed light-transmissive envelope, a volatilizable chemical fill within the envelope, an inert gas or nitrogen within the envelope to assist in starting the lamp, and means for coupling high frequency power to the envelope to produce a light emitting plasma discharge within the envelope. The fill includes as a primary active component phosphorus or a volatilizable compound of phosphorus. The inert gas or nitrogen is at a pressure of less than 760 torr at ambient temperature. In a narrower embodiment, the lamp is free of mercury. In another narrower embodiment, the fill further includes as a secondary active component sulfur or a volatilizable compound of sulfur, e.g., boron sulfide.

In another embodiment, the invention is a mercury-free and metal halide-free electrodeless high intensity discharge lamp including a sealed light-transmissive envelope, a volatilizable chemical fill within the light-transmissive envelope, xenon gas within the light transmissive envelope to assist in starting the lamp, and means for coupling high frequency power at about 13–6000 MHz to the light transmissive envelope to produce a light emitting plasma discharge within the light transmissive envelope. The fill includes as a primary active component phosphorus or a volatilizable compound of phosphorus, the amount of the primary active component being about 1–10 mg for each $cm^3$ of volume within the light transmissive envelope. The xenon gas is at a pressure of about 20–200 torr at ambient temperature. In a narrower embodiment, the fill further comprises as a secondary active component sulfur or a volatilizable compound of sulfur, e.g., boron sulfide.

BRIEF DESCRIPTION OF THE DRAWINGS

For a better understanding of the present invention, together with other objects, advantages, and capabilities thereof, reference is made to the following Description and appended Claims, together with the Drawing in which:

DETAILED DESCRIPTION OF THE PREFERRED EMBODIMENTS

Figure 1:
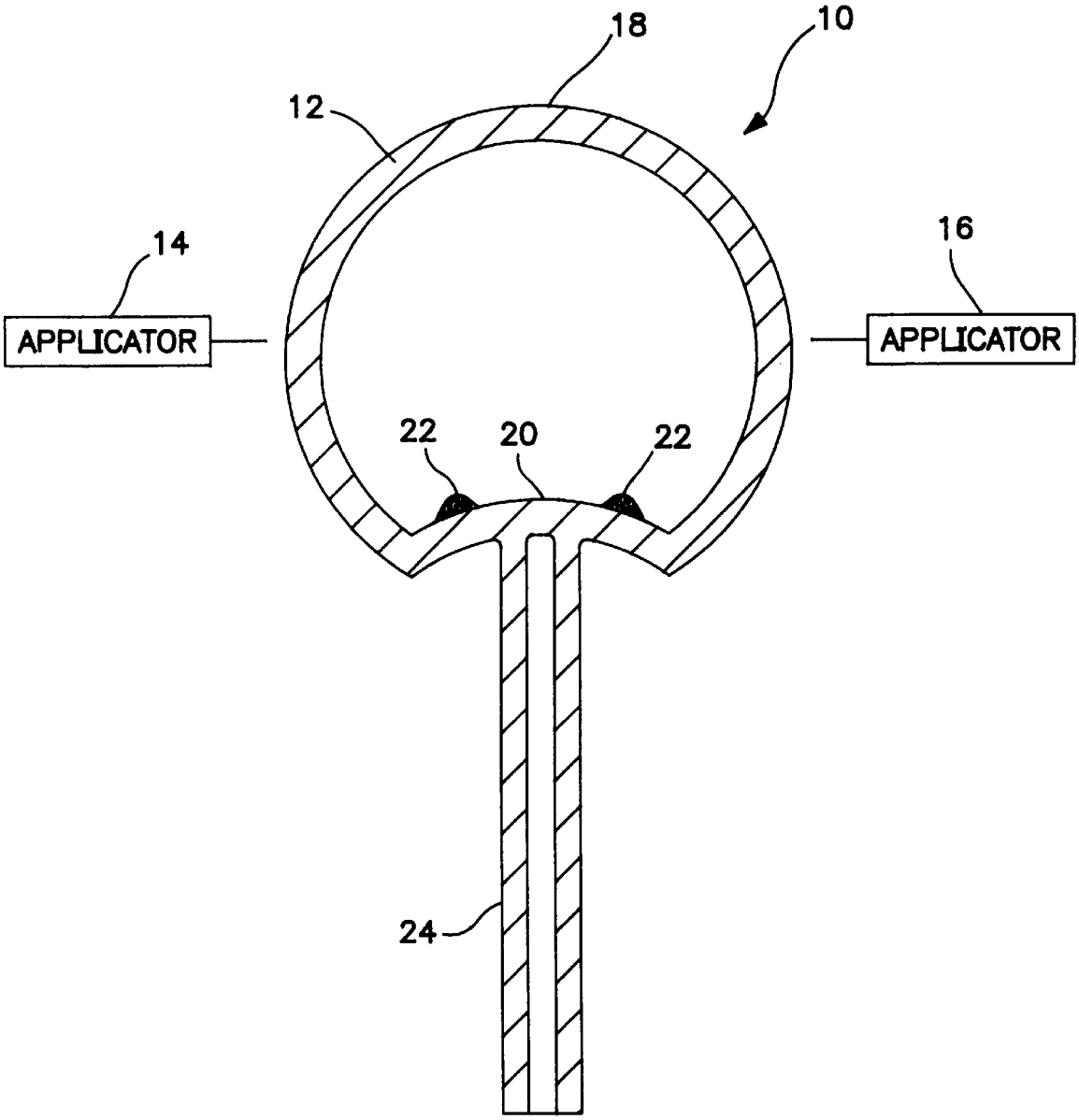
FIG. 1 is a cross-sectional schematic elevation view of a spherical electrodeless high intensity discharge lamp capsule in accordance with one embodiment of the present invention.

An exemplary embodiment of the electrodeless HID lamp in accordance with the present invention includes a mercury-free volatilizable chemical fill and an inert gas or nitrogen sealed within a light-transmissive envelope. The primary active component of the fill is phosphorus or a volatilizable compound of phosphorus which on activation will yield diatomic phosphorus ($P_2$). By the term active component is meant a volatilizable light emitting component, the primary active component being the component with the most predominant spectral emission. Optionally, sulfur or a volatilizable compound of sulfur may also be included in the fill as a secondary active component. By the term secondary active component is meant a radiating component which adds a spectral component where the primary emission is absent to fill out the spectrum and to improve lumen and color properties. Also included in the term "active component", as used herein, are precursors of the desired active component. The precursors are introduced to the lamp envelope to produce the desired compound by chemical reaction during operation of the lamp. Thus, the radiation emitted by the reacted active component precursors is in the desired range.

The phosphorus component emits in the blue to ultraviolet region of the spectrum, having a peak emission near 400 nm, while the sulfur component, if present, emits in the green to yellow region. Thus the combination emits light over a broad spectral range.

Typical phosphorus compound components are $PCl_4$, $PBr_4$, and $PI_4$, which also emit in the blue to ultraviolet range. A typical sulfur compound additive is boron sulfide ($B_2S_3$), which will shift or broaden the emission toward the yellow to red range of the visible spectrum. The lamp envelope is coupled to a high frequency power source to produce a light emitting plasma discharge within the envelope.

A small amount of one or more metals or metal halides also may be added to the lamp fill as a secondary active component, e.g., an amount only sufficient to augment the emission wavelength of the fill during operation of the electrodeless HID lamp. Typical metals include sodium, thallium, indium, gallium, and barium. The metal halide may be, e.g., sodium iodide emitting in the yellow green range, or other metal halides such as thallium, indium, gallium, barium, cesium, potassium, lithium, and scandium halides, e.g., iodides, emitting in the green, blue, and yellow ranges. In some embodiments, a small amount of mercury may be added to improve resistive heating of the lamp, typically about 1–35 mg/cm$^3$ of volume within the light transmissive envelope. However, an emission may be produced without the presence of mercury or mercury compounds.

The inert gas or nitrogen mentioned above is present within the envelope at subatmospheric pressure (less than 760 torr at ambient temperature) to facilitate starting of the lamp, i.e., establishing the light emitting plasma discharge within the envelope. These gases may be any of the Group VIII inert gas elements, nitrogen, or a combination of these. The inert gases argon, krypton, and xenon are considered to produce the most stable and best quality lamp, and are much preferred over nitrogen; most preferred is xenon. The preferred pressure for the inert gas is about 2–700 torr, more preferred is about 20–700 torr, most preferred is about 20–200 torr. At 20–200 torr, the inert gas is readily ionized by the available high frequency power, and rapidly transits to a thermal arc. At lower pressure the inert gas is easier to ionize, but transition to the thermal arc is slower and the lamp requires a longer warm-up time. At higher pressure the inert gas is more difficult to ionize, requiring a higher power application to establish the thermal arc.

The amount of volatilizable active fill components within the envelope depends on the volume of the envelope. Preferably, the lamp is operated in unsaturated mode, with no condensate present at operating temperature. The amount of fill added for operation in the unsaturated mode is preferably 1.0–3.4 mg/cm$^3$. Less preferred is operation of the lamp in saturated mode, i.e., with condensate present at operating temperature.

As mentioned above, the phosphorus emits in the blue to near UV range. The color may be slightly shifted further into the visible range, toward the green area of the spectrum, by increasing the lamp dose. This shift is achieved because increasing the lamp dose increases the pressure within the lamp, and the higher pressure tends to shift the phosphorus emission further into the visible.

Also as mentioned above, the lamp envelope is coupled to a high frequency power source to produce a light emitting plasma discharge. Preferably, the lamp is powered by a high frequency RF source operating at about 13–6000 MHz. More preferably, the power source operates within the ISM bands (Industrial, Scientific and Medical bands, established by the Federal Communications Commission) throughout that region of the electromagnetic spectrum, most preferably in the ISM bands centered around 915 and 2450 MHz.

The discharge is initiated in the inert gas, which then heats and volatilizes the chemical fill, increasing the vapor pressure within the envelope. The active component or components then begin to dissociate and ionize, emitting within the spectral ranges mentioned above. The plasma arc temperature is influenced by the vapor pressure within the envelope and the power applied thereto. The arc temperature, in turn, influences the distribution of population in the excited molecular electronic state. Thus, the wavelength of the maximum emission may be shifted slightly by varying the power applied to the envelope. Further, the high operating pressure of the vaporized active component(s) provides thermal insulation to isolate the core of the discharge, raising the arc core temperature and permitting population of the higher vibrational levels of the excited state(s) of the active component(s).

The preferred high frequency power source for the lamps disclosed herein is a microwave power source. Most preferred is a microwave power source including a plurality of electric field applicators spaced around the envelope. A power splitter and phase shifter cause the electric field applied to the envelope by the applicators to rotate at the frequency of the power source. Such a power source is disclosed in U.S. patent application Ser. No. 08/248,921 filed May 24, 1994, incorporated herein by reference. Alternatively, another type of high frequency power source may be utilized, e.g., that disclosed in above-referenced U.S. Pat. No. 5,070,277 or other known high frequency applicators. Preferably, the applicator used should permit the lamp to be small with a well concentrated high frequency powered plasma. The entire applicator preferably is mountable within an optic which is optimizable for collection of the emitted light independently of the microwave power source.

The lamp capsule, or light transmissive envelope, is fabricated from vitreous silica (commonly called quartz), synthetic silica, hard glass, ceramic (e.g., polycrystalline alumina or yttria), or a single crystalline material such as a crystalline alumina (sapphire). The lamp capsule also may be fabricated from a broad range of other materials, including lower temperature glasses than are usable with prior art electrodeless HID lamps. The lower temperature glasses are permitted because the volatilizable primary active material vaporizes at a lower temperature than prior art primary active materials, and is less chemically reactive with the glass than the metal salts used in conventional HID lamps.

The description below of various illustrative embodiments shown in the Drawing refers to an automotive lamp. However, the description is not intended to limit the scope of the present invention, but merely to be illustrative and representative thereof.

Referring now to FIG. 1, electrodeless HID lamp 10 in accordance with one embodiment of the present invention includes spherical electrodeless lamp capsule 12, described in more detail below, and electric field applicators 14 and 16 on either side of and in close proximity to lamp capsule 12. Applicators 14 and 16 are used for nonresonant coupling of high frequency electromagnetic power to lamp capsule 12. In a preferred alternative arrangement, applicators 14 and 16 are two of four electric field applicators of the system described in above-referenced application Ser. No. 08/248,921. The electric field applicators are preferably helical couplers or helical coils. The electric field applicators are spaced around lamp capsule 12 in a plane intersecting the center of the lamp capsule and spaced at 90° intervals with respect to the lamp capsule center. A high frequency power source (not shown) supplies high frequency power to a power splitter (not shown) and phase shifter (not shown) such that the electric field applied to lamp capsule 12 by the four applicators rotates at the frequency of the power source. In another alternative arrangement, not shown, a pair of applicators may be located above and below lamp envelope 18, aligned with its axis of rotation (not shown).

Envelope 18 of lamp capsule 12 is fabricated of a light transmissive material through which the high frequency power passes substantially unattenuated. The material of lamp envelope 18 may be quartz, synthetic silica, hard glass, ceramic, or a single crystalline material such as sapphire.

Lamp envelope 18 is shown in FIG. 1 as spherical, but may be of any shape conventional for electrodeless lamp capsules, e.g., generally prolate or oblate ellipsoidal in cross section, e.g., a cross section normal to the plane of excitation. Preferably, lamp envelope 18 has an approximately circular cross section in the plane of excitation. The inner diameter of lamp capsule 18 is preferably about 1–12 mm, more preferably 2–8 mm. The wall thickness may be, e.g., about 0.25–2.0 mm. If lamp envelope 18 is to be operated in saturated mode, it may have one or more dimples, as dimple 20, extending into its interior volume to assist in controlling distribution of fill condensate 22. In such a saturated mode lamp, condensate 22 forms a ring around dimple 20. Support rod 24, which may be tubular as shown or solid and is preferably aligned with the center of lamp envelope 18, supports lamp envelope 18. A second support (not shown) may be positioned diametrically opposite rod 24 and co-linear therewith.

Lamp envelope 18 contains an ionizable inert gas or nitrogen, preferably xenon, at about 20–200 torr at ambient temperature. Lamp envelope 18 also contains a vaporizable phosphorus fill material which, when volatilized, is partially ionized and partially excited to radiating states so that useful light is emitted by the discharge.

In operation, the power source is switched on, establishing an electric field at the center of the lamp envelope and ionizing the inert gas or nitrogen component. The molecules of the active component(s) vaporize, diffuse into and, if present as compounds, dissociate in the arc, producing light.

The following Example is presented to enable those skilled in the art to more clearly understand and practice the present invention. This Example should not be considered as a limitation upon the scope of the present invention, but merely as being illustrative and representative thereof.

EXAMPLE

Figure 2:
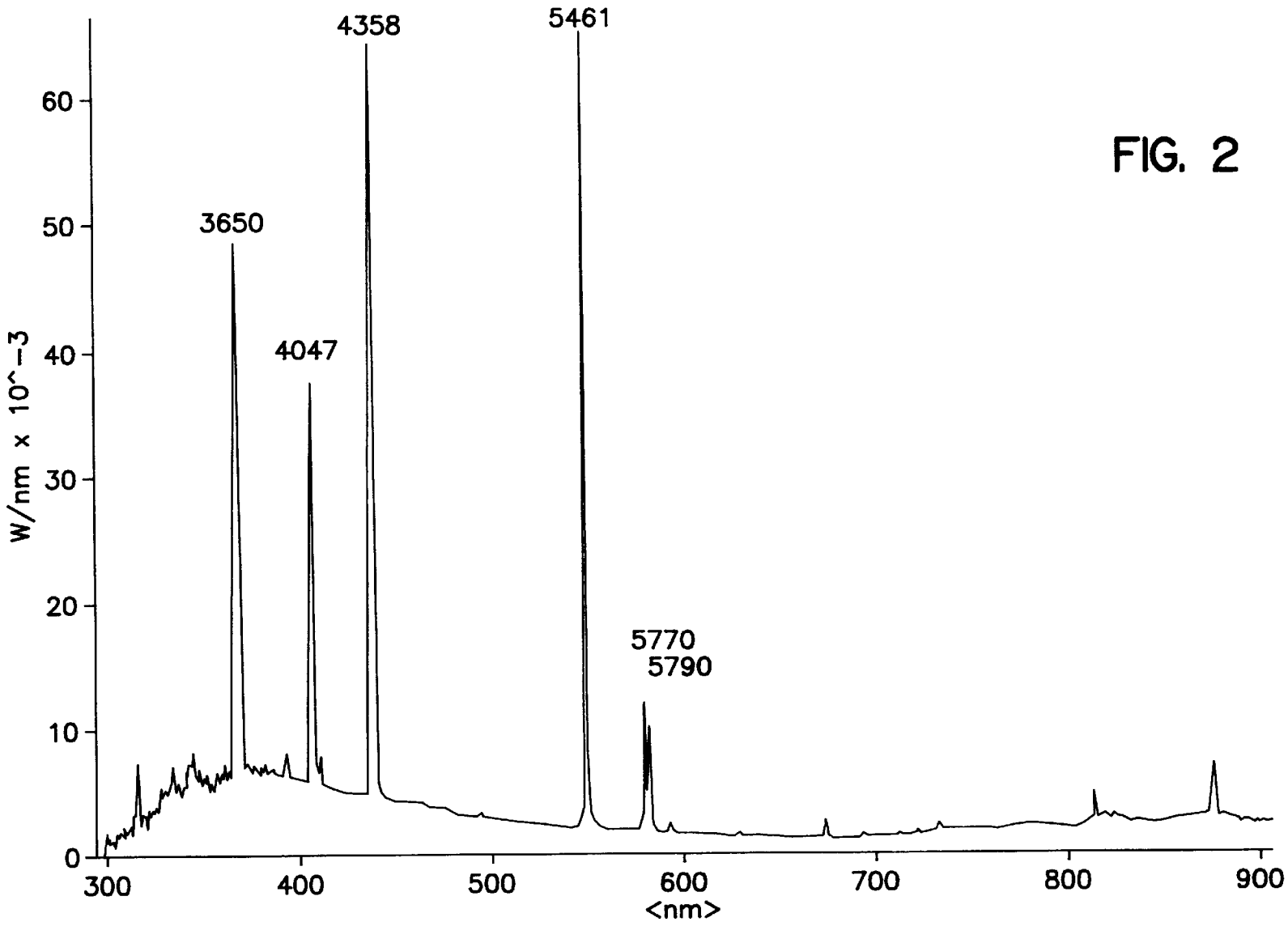
FIG. 2 is a plot of the emission spectrum of the fill of a lamp in accordance with another embodiment of the invention.

A 60 W electrodeless HID lamp was prepared by filling a tubular electrodeless HID automotive lamp capsule, 2 mm ID, 4 mm OD, 10 mm internal length, with a phosphorus fill and krypton inert gas at 10 torr pressure. Mercury was added in an amount of 0.9 mg to the lamp capsule to improve resistive heating. The emission spectrum of the lamp fill is shown in FIG. 2, showing Hg peaks at 365.0, 404.7, 435.8, 546.1, 577.0, and 579.0 nm. The phosphorus $P_2$ emission is a continuum, peaking at about 380 nm and extending into the near infrared region of the spectrum.

The lamp capsule was sealed and mounted within a high frequency RF source to provide high frequency power to the lamp at 915 MHz. The lamp operated in unsaturated mode, providing 235 lumens of light. The correlated color temperature of the lamp was 14900 K; the general color rendering index was 70 Ra.

The invention described herein presents to the art a novel, improved electrodeless HID lamp having a phosphorus fill, and requiring no mercury or mercury salts and no substantial amount of metal halides. The phosphorus fill emits in the blue to ultra violet range of the spectrum and, with the additives described above, the emission may be shifted or broadened to include the yellow-green, yellow, or red ranges of the visible spectrum.

While there has been shown and described what are at present considered the preferred embodiments of the invention, it will be apparent to those skilled in the art that modifications and changes can be made therein without departing from the scope of the present invention as defined by the appended Claims.

We claim:

1. An electrodeless high intensity discharge lamp comprising:

a sealed light-transmissive envelope;

a volatilizable chemical fill within said envelope, said fill including as a primary active component phosphorus or a volatilazable compound of phosphorus;

an inert gas or nitrogen within said envelope to assist in starting said lamp, said inert gas or nitrogen being at a pressure of less than 760 torr at ambient temperature;

said fill is free of mercury; and means for coupling high frequency power to said envelope to produce a light emitting plasma discharge within said envelope.

2. A lamp in accordance with claim 1 wherein said fill further comprises as a secondary active component sulfur or a volatilizable compound of sulfur.

3. A lamp in accordance with claim 2 wherein said secondary active component comprises boron sulfide.

4. A lamp in accordance with claim 1 wherein said lamp is free of metal halides.

5. A lamp in accordance with claim 1 further comprising an amount of a metal halide within said envelope sufficient to augment the emission wavelength of said fill during operation of said lamp.

6. A lamp in accordance with claim 5 wherein said metal halide is selected from the group consisting of iodides of sodium, cesium, potassium, lithium, scandium, thallium, indium, gallium, and barium.

7. A lamp in accordance with claim 1 wherein the amount of said primary active component is about 1–3.4 mg for each $cm^3$ of volume within said envelope.

8. A lamp in accordance with claim 1 wherein said inert gas or nitrogen is at a pressure of about 2–700 torr at ambient temperature.

9. A lamp in accordance with claim 8 wherein said inert gas or nitrogen is at a pressure of about 20–200 torr at ambient temperature.

10. A lamp in accordance with claim 8 wherein said lamp comprises an inert gas, said inert gas being xenon, argon, or krypton.

11. A lamp in accordance with claim 1 wherein said coupling means applies said high frequency power at about 13–6000 MHz.

12. A lamp in accordance with claim 1 wherein said light-transmissive envelope is fabricated from a light transmissive material selected from the group consisting of vitreous silica, synthetic silica, glass, sapphire, and ceramic.

13. A mercury-free electrodeless high intensity discharge lamp comprising:

a sealed light-transmissive envelope;

a volatilizable chemical fill within said light-transmissive envelope, said fill including as a primary active component phosphorus or a volatilizable compound of phosphorus, the amount of said primary active component being about 1–10 mg for each $cm^3$ of volume within said light transmissive envelope;

xenon gas within said light transmissive envelope to assist in starting said lamp, said xenon gas being at a pressure of about 20–200 torr at ambient temperature;

means for coupling high frequency power at about 13–6000 MHz to said light transmissive envelope to produce a light emitting plasma discharge within said light transmissive envelope.

14. A lamp in accordance with claim 13 wherein said fill further comprises as a secondary active component sulfur or a volatilizable compound of sulfur.

15. A lamp in accordance with claim 14 wherein said secondary active component comprises boron sulfide.

16. A lamp in accordance with claim 13 wherein said lamp is free of both mercury and metal halides.

* * * * *